United States Patent [19]

Greiser et al.

[11] Patent Number: 4,755,423

[45] Date of Patent: Jul. 5, 1988

[54] LAMINATE

[75] Inventors: Wolfgang Greiser, Neusäss/Hainhofen; Kurt Plötz, Bobingen; Hans Wagner, Bobingen; Karl-Christian Zerfass, Bobingen, all of Fed. Rep. of Germany

[73] Assignee: Hoechst Aktiengesellschaft, Frankfurt am Main, Fed. Rep. of Germany

[21] Appl. No.: 16,239

[22] Filed: Feb. 19, 1987

[30] Foreign Application Priority Data

Feb. 22, 1986 [DE] Fed. Rep. of Germany ..... 3605830

[51] Int. Cl.[4] ..... B32B 15/00

[52] U.S. Cl. ..... 428/284; 428/285; 428/287; 428/293; 428/294; 428/300; 428/301; 428/340; 428/489

[58] Field of Search ..... 428/284, 285, 287, 293, 428/294, 300, 301, 340, 489, 232

[56] References Cited

U.S. PATENT DOCUMENTS

| | | | |
|---|---|---|---|
| 2,910,763 | 11/1959 | Lauterbach | 428/300 |
| 3,975,565 | 8/1976 | Kendall | 428/300 |
| 4,135,029 | 1/1979 | Pfeffer | 428/294 |
| 4,230,762 | 10/1980 | Iwasaki et al. | 428/300 |
| 4,464,429 | 8/1984 | Soret | 428/294 |
| 4,522,876 | 6/1985 | Hurs | 428/300 |

*Primary Examiner*—James J. Bell

*Attorney, Agent, or Firm*—Connolly and Hutz

[57] ABSTRACT

Laminates, which are composed of a preconsolidated synthetic fiber web and a preconsolidated mineral fiber web, which are bonded to each other by needling, are improved in respect of their dimensional stability, in particular in the transverse direction, when the preconsolidated mineral fiber wet contains reinforcing yarns of a mineral material and extending in the longitudinal direction.

They are preferably used as carrier web for roofing and sealing webs.

7 Claims, No Drawings

LAMINATE

The present invention relates to an improvement on the laminate of U.S. patent application Ser. No. 780,392, which comprises a preconsolidated synthetic fiber web and a preconsolidated mineral fiber web, which are bonded to each other by needling, and which is used as a carrier web for the manufacture of roofing and sealing webs.

Laminates as described in U.S. patent application Ser. No. 780,392 and the bitumen webs manufactured therefrom exhibit good thermomechanical properties and a distinctly improved behaviour in fire. The low dimensional change values of 0.2 to 0.5% even permit a one-ply laying of bitumen webs on the roof.

The present invention has for its object, while preserving all the advantages of the laminate described in U.S. patent application Ser. No. 780,392, to improve the dimensional stability once more, including especially in the transverse direction in order to obtain even more reliability in respect of its use as a carrier web for one-ply roofing webs.

Surprisingly, a distinct improvement in dimensional stability in the transverse direction is obtained by using a preconsolidated mineral fiber web which contains mineral reinforcing yarns in the longitudinal direction.

Glass fiber webs with reinforcing yarns made of glass have been found to be particularly suitable.

Individual and total counts of these reinforcing yarns are adapted to the particular stated object, as is the spacing between the longitudinal reinforcing yarns.

In the customary and preferred application area as also described in U.S. patent application Ser. No. 780,392, i.e. with weights per unit areas of the polymer web of from 50 to 350 g/m$^2$ and from 10 to 100 g/m$^2$ for the glass fiber web, suitable spacings between the glass yarns are 5 to 25 mm, coupled with a count of 500 to 2500, preferably 1100, dtex. These spacings between the glass yarns need not be complied with exactly.

The choice of filament denier and of the spacing between the reinforcing yarns makes possible to determine the stress/strain behavior of the laminates. Here the objective is to combine the steep initial modulus of the glass yarns which is important for use in bitumen webs with the subsequent flatter stress/strain behavior of the polyester in such a way that, ideally, a continuous transition in the stress/strain behavior is obtained.

The sheet of longitudinal, parallel reinforcing yarns made of glass not unexpectedly improves the thermomechanic properties of the laminate in the longitudinal direction. Surprisingly, however, the improvement in the dimensional stability in the transverse direction is distinctly more marked than in the longitudinal direction. The transverse dimensional stability is improved by a factor of 15 to 30, in particular 19 to 30.

Particularly preferred embodiments of the present invention have the features specified in claims 2 to 6.

The laminate according to the invention is highly suitable for use as a carrier web for roofing and sealing webs, and also for manufacturing special webs such as, for example, roll laminating webs, cold self-adhesive webs or shingles.

Laid roofing webs can under certain conditions (absence of wind, intensive and prolonged sunlight) reach temperatures of 70° to 80°C.

The dimensional change at 80° C. is to characterize the behavior of the roofing web under the temperature fluctuations on the roof, and is determined as follows:

Two measurement sections of 25 cm in the longitudinal and transverse directions are marked out on a piece of the roofing web (ca. 30 cm×30 cm). The test specimens are then placed for one hour in a heating cabinet which is maintained at exactly 80° C. (±1°C.). After the heat treatment, the still soft roofing web test specimen is carefully removed from the heating cabinet together with the underlay, a narrow-mesh V2A stainless steel wire grid. The test specimen is slowly picked uo simultaneously at two corners and then placed on a paper web, for example crepe paper, so that, in the course of cooling down, no impairment of a possible contraction occurs.

After 1 hour of cooling, the distances between the marks are determined, and the changes—relative to the original distances—are quoted in percent.

This method of measurement was developed in line with SIA standard 281 and the UEAtc guideline for roof-sealing systems. This method was also used in the examples below for determining the dimensional change.

The examples below demonstrate the advantages of the laminate according to the invention as a carrier web for bitumen webs. However, the laminate according to the invention is also suitable for use as a carrier web for coating of bitumen modified with elastomers or plastomers, for sealing webs in road and bridge building and similar applications.

EXAMPLES (A) A laminate is produced in accordance with the state of the art from a polyester web having a weight per unit area of 250 g/m$^2$, which has been consolidated by needling, and an unneedled glass fiber web having a weight per unit area of 50 g/m$^2$ . The dimensional change longitudinal/transverse, measured by the method described above is −0.45/+0.32%.

(B) A laminate is manufactured in accordance with U.S. patent application Ser. No. 780,392 by preconsolidating a polyester web having a weight per unit area of 160 g/m$^2$ by needling with a small number of stitches, needling it together with a likewise preconsolidated glass fiber web which has a weight per unit area of 60 g/m$^2$ and no yarn reinforcement, and finally consolidating with a customary binder. The dimensional change longitudinal/transverse, measured by the method described above, is −0.44/+0.19%.

(C) A laminate according to the invention is manufactured by preconsolidating a polyester web having a weight per unit area of 280 g/m$^2$ by needling with a small number of stitches, needling it together with a likewise preconsolidated glass web which has a weight per unit area of 50 g/m$^2$ and which contains 0.6 threads/cm of a reinforcing yarn having a count of 550 dtex, and finally consolidating with a customary binder. The dimensional change longitudinal/transverse, measured by the method described above, is −0.26/+0.01%.

A comparison of the transverse dimensional changes in the laminates of examples A and B with the transverse dimensional change of the laminate according to the invention of example C shows the surprising improvement in transverse dimensional stability by a factor of 19.

We claim:

1. A laminate, having improved dimensional stability and fire resistance and being preferably applied as a carrier web for roofing sheets, comprising the combination of a preconsolidated synthetic fiber web and a preconsolidated mineral fiber web, which are bonded to each other by needling, wherein the mineral fiber web contains longitudinal reinforcing yarns made of a mineral material.

2. The laminate as claimed in claim 1, wherein the synthetic fiber web comprises polyethylene terephthalate fibers.

3. The laminate as claimed in claim 1, wherein the synthetic fiber web is a filament web which has been preconsolidated in a conventional manner.

4. The laminate as claimed in claim 3, wherein the weight per unit area of the filament web is 50 to 350 $g/m^2$ coupled with a filament denier of 3 to 8 dtex.

5. The laminate as claimed in claim 1, wherein the mineral fiber web is a wet-laid staple fiber web.

6. The laminate as claimed in claim 5, wherein the mineral fiber web has a weight per unit area between 30 and 60 $g/m^2$.

7. Use of the laminate of claim 1 as a carrier web for roofing and sealing webs.

* * * * *